US006354325B1

(12) United States Patent
Warnes et al.

(10) Patent No.: US 6,354,325 B1
(45) Date of Patent: Mar. 12, 2002

(54) UNDERGROUND ACCESS CONDUIT

(75) Inventors: Kenneth F. Warnes, Vancouver, WA (US); Christian O. Nelson, Hillsboro, OR (US); Frank M. McElheran, Portland, OR (US); Lance S. Landis, West Linn, OR (US); Thane J. Landis, Portland, OR (US); William R. Huseby; John Barker, both of Vancouver, WA (US); Matthew S. Cameron, Portland, OR (US)

(73) Assignee: 3 Dimensional Contracting, Inc., Portland, OR (US)

( * ) Notice: Subject to any disclaimer, the term of this patent is extended or adjusted under 35 U.S.C. 154(b) by 0 days.

(21) Appl. No.: 09/773,395

(22) Filed: Jan. 31, 2001

Related U.S. Application Data

(60) Provisional application No. 60/242,621, filed on Oct. 23, 2000.

(51) Int. Cl.[7] ..... F16L 5/00; F16L 5/08

(52) U.S. Cl. ..... 137/367; 137/369; 137/370

(58) Field of Search ..... 137/367, 369, 137/370, 371

(56) References Cited

U.S. PATENT DOCUMENTS

| | | | | |
|---|---|---|---|---|
| 613,652 A | | 11/1898 | Chadbourne | |
| 996,956 A | | 7/1911 | Walcott | |
| 1,000,108 A | | 8/1911 | Mueller | |
| 2,008,138 A | | 7/1935 | Le Duc | 137/13 |
| 2,059,085 A | | 10/1936 | Buck | 137/13 |
| 4,331,178 A | | 5/1982 | Handley et al. | 137/366 |
| 4,534,378 A | | 8/1985 | Gagas et al. | 137/367 |
| 4,819,687 A | | 4/1989 | Alberico et al. | 137/367 |
| 5,634,488 A | | 6/1997 | Martin, Jr. | 137/370 |
| 5,730,180 A | | 3/1998 | Alberico | 137/367 |
| 5,871,030 A | * | 2/1999 | Agbay | 137/382 |
| 5,988,209 A | * | 11/1999 | Hardy | 137/382 |
| 6,009,897 A | * | 1/2000 | Hill et al. | 137/382 |

* cited by examiner

*Primary Examiner*—A. Michael Chambers
(74) *Attorney, Agent, or Firm*—Kolisch, Harwell, Dickinson, McCormack & Heuser

(57) ABSTRACT

A valve cover for enclosing an underground area surrounding the actuating mechanism of a flow control valve. The valve cover includes a body having a structure configured to position the valve cover in a desired orientation relative to the flow control valve. This positioning structure may be at least partially elastomeric, and configured to resiliently deform and urge against the flow control valve when the valve cover body is placed over the valve actuating mechanism. This maintains the valve cover body seated in a centered, leveled orientation relative to the valve actuating mechanism. The positioning structure may also be formed as a spacer configured to contact the valve actuating mechanism itself and space the actuating mechanism from the valve cover body. The valve cover body is configured so that, when it is installed, a valve tool may be freely inserted into the enclosed underground area and operatively engaged with the valve actuating mechanism.

26 Claims, 4 Drawing Sheets

UNDERGROUND ACCESS CONDUIT

CROSS-REFERENCE TO RELATED APPLICATION

This application claims priority from U.S. Provisional Patent Application Ser. No. 60/242,621, filed Oct. 23, 2000 for UNDERGROUND VALVE COVER.

FIELD OF THE INVENTION

The present invention is related to access conduits for allowing an underground valve or other underground mechanism to be operated from an aboveground position.

BACKGROUND OF THE INVENTION

Flow control valves used with underground water pipes often include underground actuating mechanisms that must be operated from an aboveground position. Typically, the actuating mechanism takes the form of a nut secured to the outer housing of the valve. Rotating the nut causes a flow control device of the valve to move between a fully open and a fully closed position. This varies the effective cross-sectional area through which fluid can flow, and thus adjusts the flow rate through the section of piping. An access conduit is often provided to allow an aboveground user to access and operate the actuating nut by extending a tool known as a valve key through the conduit.

Typically, an access conduit is provided by vertically positioning a length of piping, known as riser pipe, over the actuating nut. Once the riser pipe is situated, the areas surrounding the riser pipe and valve are backfilled with dirt, rock or other fill material. No mechanism or structure is provided to seat or otherwise secure the conduit in a desired position relative to the valve. Accordingly, the conduit must be manually held in place while the surrounding areas are backfilled. This complicates and slows installation of the access conduit. In addition, it is not uncommon for shifting or settling of the access conduit to occur either during or after the backfilling operation. This may result in the access conduit becoming unleveled or off-center, as respectively depicted on the left and right sides of FIG. 1, making it more difficult to operate the actuating nut with a valve tool inserted through the conduit. Access to and operation of the actuating mechanism is further complicated by the tendency of debris to accidentally enter the riser pipe and accumulate around the actuating nut.

SUMMARY OF THE INVENTION

The present invention provides a valve cover for enclosing an underground area surrounding the actuating mechanism of a flow control valve. The valve cover includes a body having a structure configured to position the valve cover in a desired orientation relative to the flow control valve. This positioning structure may be at least partially elastomeric, and configured to resiliently deform and urge against the flow control valve when the valve cover body is placed over the valve actuating mechanism. This maintains the valve cover body seated in a centered, leveled orientation relative to the valve actuating mechanism. The positioning structure may also be formed as a spacer configured to contact the valve actuating mechanism itself and space the actuating mechanism from the valve cover body. The positioning structure and valve cover body are configured so that, when they are installed, a valve tool may be freely inserted into the enclosed underground area and operatively engaged with the valve actuating mechanism.

DETAILED DESCRIPTION OF THE INVENTION

Figure 2:
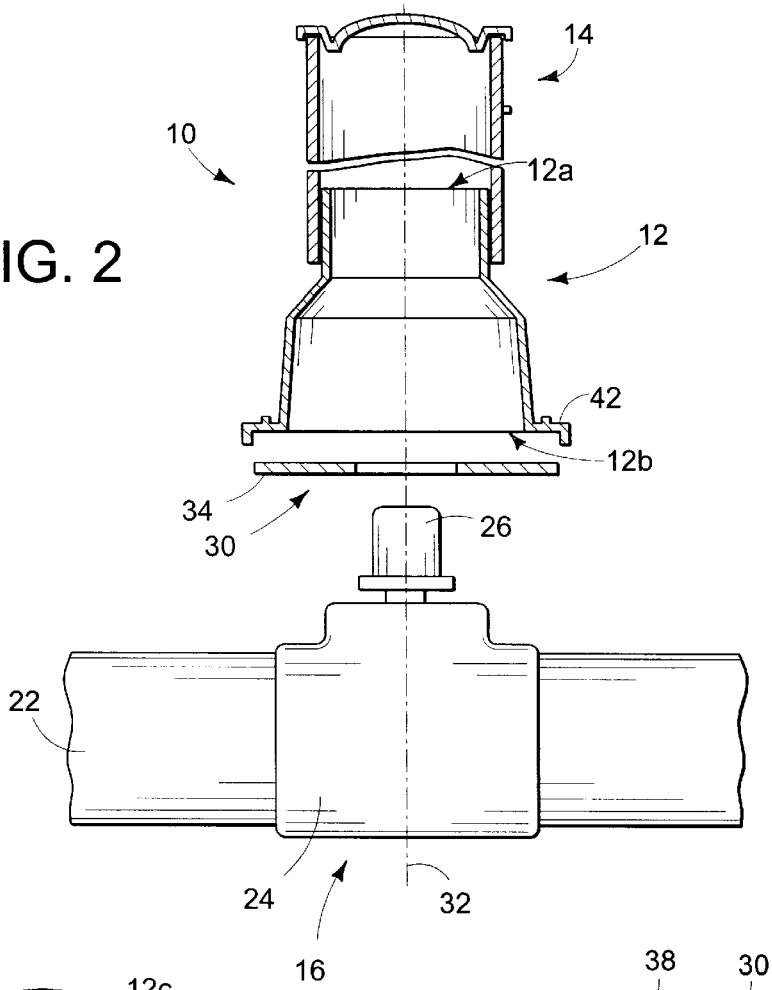
FIG. 2 is an exploded, partially cross-sectioned view of an access conduit according to the present invention.

FIG. 2 depicts an improved conduit 10 for providing access to an underground flow control valve, such as gate valve 16. Flow control valves generally include a flow control device that is selectively movable between a fully closed and a fully open position to vary flow rate through the valve. The position of the flow control device typically is controlled through operation of an actuating mechanism mounted on the outer housing of the valve. More particularly, valve 16 is a type of valve known as a gate valve. Gate valve 16 includes a valve bonnet 24 (the outer housing), a gate mechanism (the flow control device) and an actuating nut 26 mounted atop the valve bonnet. Selective rotation of actuating nut 26 adjusts the position of the gate mechanism to vary flow rate through the gate valve and piping section 22.

For purposes of illustration only, the present invention will be described in the context of a conventional gate valve, as described above. It should be appreciated, however, that the access conduit of the present invention may be employed to provide access to other types of valves or any other underground device where it is desired to access the device from an aboveground position. For example, underground gas lines are often provided with emergency shut-off valves. The access conduit of the present invention may easily be modified to provide a conduit through which an actuating mechanism of such a valve is accessed and operated.

Access conduit 10 includes a valve cover 12 and a length of riser pipe 14. Valve cover 12 and riser pipe 14 are fitted together and placed over valve 16 to provide an unobstructed passageway extending from the ground surface to actuating nut 26 through the soil, rock and other fill material surrounding the valve and access conduit. Piping section 22, on which valve 16 is provided, may be installed at various depths beneath the ground surface depending, for example, on the type of fluid the pipe is to carry. Municipalities often have two separate water systems; one for sanitary uses (drinking, bathing, etc.) and a second, non-sanitary sewer system. To prevent contamination and health hazard, the non-sanitary system is typically installed at a greater depth than the sanitary system. Many municipal codes require, for example, that sewer lines be installed at least six feet below the ground surface, and that any sanitary system be installed at a shallower depth. The access conduit of the present invention may be employed in varying depths with a wide variety of underground piping systems.

As indicated above, access conduit 10 includes riser pipe 14 and valve cover 12. The valve cover partly forms a lower terminal end of access conduit 10, and may be thought of as an adapter for securing riser pipe 14 to underground piping 22 in the vicinity of gate valve 16. Valve cover 12 includes an at least partially hollow body having an open top end 12*a* and an open bottom end 12*b*. The open ends allow for insertion of a valve tool through the interior of the valve cover, in order to access and operate nut 26.

The upper portion of the valve cover body is adapted to be firmly secured to the lower end of riser pipe 14. The bottom portion of the valve cover body is sized to enclose a relatively large volume surrounding actuating nut 26, and typically is wider than the upper portion of the valve cover body. In particular, valve cover 12 is dimensioned so that when it is centered over actuating nut 26, the interior walls of the valve cover body are spaced from the nut so as to permit unrestricted access to the nut. This enables an operator situated in an aboveground position to easily access and operate the actuating nut by inserting a valve tool through the access conduit into the enclosed volume surrounding the nut. Further, it is preferable that the valve body be sized large enough to permit free operation of the nut even in the event of debris entering the conduit and settling into the areas surrounding the nut, as may happen from time to time.

Allowing for the basic considerations of enclosing an area around nut 26 and providing a fitting to secure riser pipe 14 in place, the valve cover body can be made in a variety of shapes and sizes. For example, in the depicted embodiment, there is a sharp, stepped transition between the wide bottom and narrower top section of the valve cover body. However, the body may instead be formed to have a conical shape, or to otherwise provide a smooth/continuous transition between upper and lower sections of the valve cover body. Both the upper and lower sections of the depicted valve cover body have generally circular cross sections, though the design may easily be modified so that the cross section is square, elliptical, or any other desired shape. As previously indicated, the valve cover body is sized to enclose an area around nut 26 sufficiently large so as to freely accommodate insertion of a valve tool into the area to operatively engage the nut. The size of the valve cover body will also depend on the diameter of the riser pipe to which the valve cover body is secured.

Typically, the valve cover body is formed from a rigid plastic that will not degrade when deployed in an underground position in which its outer surface is in contact with soil and other fill material. Materials other than plastic that are suited to this environment may also be used to form the valve cover body. Regardless of the particular material used, the walls of the valve cover body should be thick enough to withstand the inward-directed forces exerted by the surrounding fill material.

Figure 1:
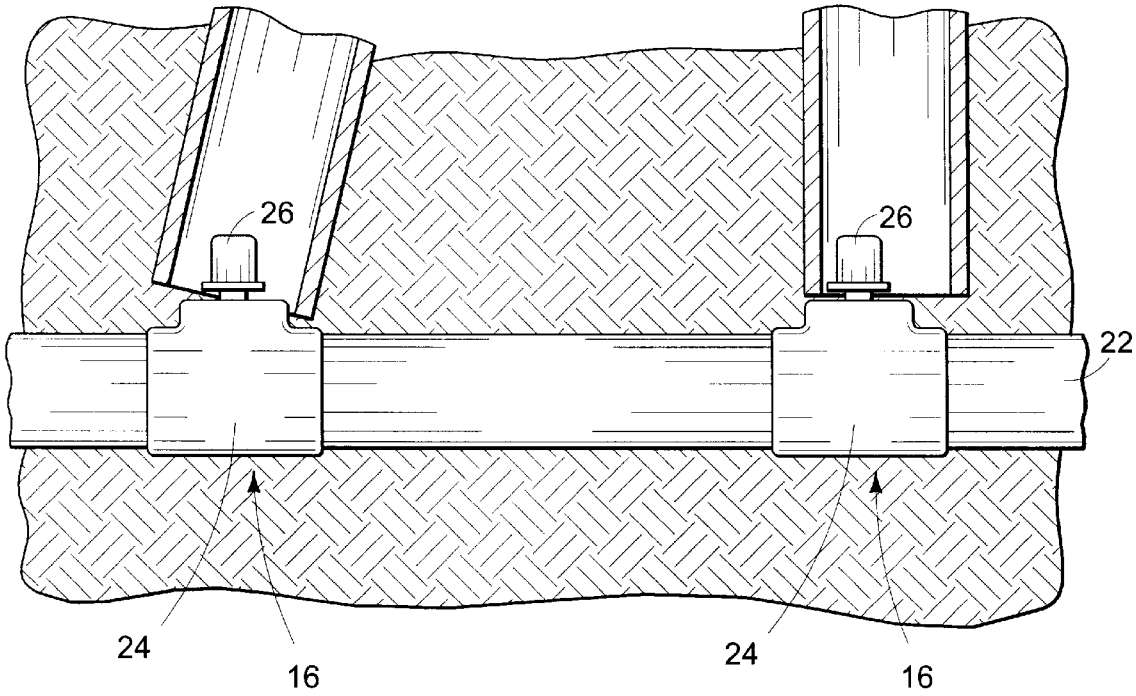
FIG. 1 (PRIOR ART)
FIG. 1 depicts problems associated with prior art conduits used to provide access to underground valves.

Valve cover 12 also includes a seating structure 30 configured to seat the valve cover in a desired position on valve 16 so that it is centered and level relative to actuating nut 26. By "centered," it is meant that the valve cover is situated so that actuating nut 26 is spaced from the interior walls of the valve cover body, in order to permit free and unobstructed use of a valve tool to access and operate the actuating nut. The right side of FIG. 1 depicts a prior art access conduit that is not centered. In many cases, when the valve cover is centered, the rotational axis of actuating nut 26 will lie along a longitudinal axis 32 extending through the center of the passageway defined by access conduit 10.

By "level," it is meant that valve cover 12 is seated so that a length of riser pipe secured to the valve cover body will provide a passageway which is optimally oriented for allowing the valve tool to engage actuating nut 26. Actuating nuts and valve tools are normally designed so that the long axis of the tool handle is aligned with the rotational axis of the valve nut when the nut is operatively engaged with the head of the tool. A conventional tool of this type will extend perpendicularly away from pipe 22 (FIG. 1) when properly engaged with nut 26. The access conduit depicted on the left side of FIG. 1 is not level, and thus would make it difficult to access the nut using such a conventionally configured valve tool.

Generally, seating structure 30 includes a spacer extending inward from the valve cover body. The spacer contacts the valve housing, valve actuating mechanism, or some other portion of the valve in order to maintain the interior walls of the valve cover body spaced from the valve actuating mechanism. The spaced orientation of the valve cover and valve actuating mechanism ensures that a valve tool inserted through the access conduit can freely engage and operate the actuating mechanism.

Seating structure 30 may be formed to be at least partially elastomeric so that it resiliently deforms when valve cover 12 is situated on gate valve 16 in the desired orientation relative to actuating nut 26. The resilient deformation causes the seating structure to urge against valve 16, to thereby seat the valve cover and maintain it in place over actuating nut 26. Typically, the seating structure is provided with an opening through which a portion of valve 16 is disposed in order to seat the valve cover. When the seating structure is in its undeformed rest state, the opening typically is smaller than the portion of valve 16 that is positioned through the opening when valve cover 12 is fully seated on the valve. Valve cover 12 is seated on valve 16 by bringing the valve cover down over the valve so that some portion of the valve extends through the opening far enough to deform the seating structure from its rest state.

Figure 3:
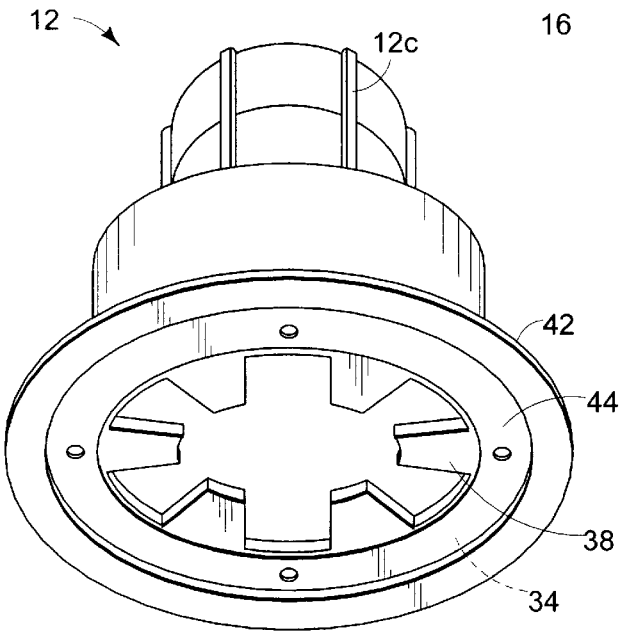
FIG. 3 is an isometric view of a valve cover according to the present invention.
Figure 4:
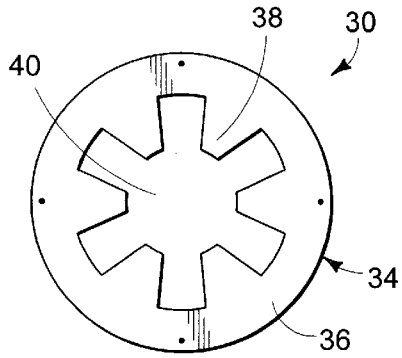
FIG. 4 is a top view of the seating structure used with the valve cover depicted in FIGS. 2 and 3.
Figure 6:
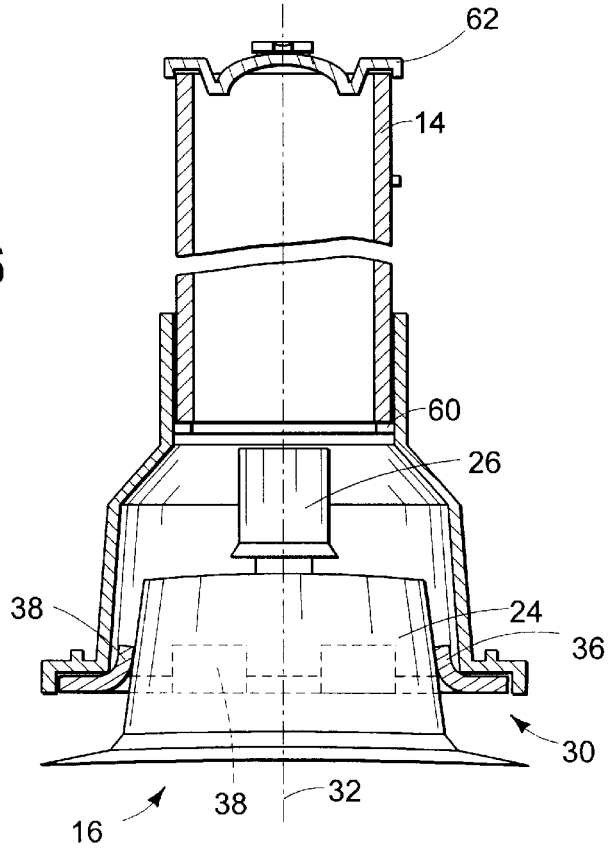
FIG. 6 is a partially cross-sectioned view of an access conduit similar to that depicted in FIG. 2, but having an alternately configured valve cover. The figure depicts the access conduit as installed on an underground flow control valve.

The valve cover depicted in FIGS. 2–4 incorporates such a seating structure in the form of a seating ring 34 having an outer portion 36 and a number of flexible, elastomeric fingers 38 that extend inward. Fingers 38 extend inward from the valve cover body toward the interior region bounded by the valve cover. FIG. 4 depicts the seating ring in its undeformed rest state, while FIG. 6 depicts the seating ring in a partially deformed condition occurring when the valve cover is seated. As best seen in FIG. 4, the innermost tips of fingers 38 define a generally circular opening 40 through which valve 16 is partially received when valve cover 12 is seated in place.

Seating ring 34 is secured to a flange region 42 located at the bottom of the valve cover body. Specifically, outer portion 36 of seating ring 34 is sandwiched between an annular mounting plate 44 and flange region 42 of the valve cover body and secured in place using threaded fasteners. Alternatively, adhesive or other suitable means may be employed to mount the seating ring to the valve cover body. In addition, whether threaded fasteners or one of these alternate means are used, the depicted design may be modified as desired to omit mounting plate 44.

Figure 5:
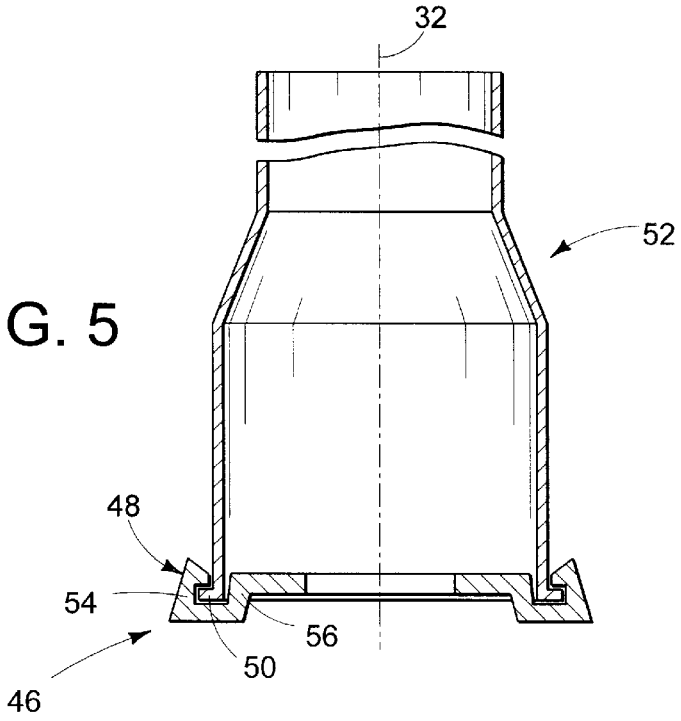
FIG. 5 is a partially cross-sectioned view of a valve cover according to the present invention having an alternately configured seating structure.

FIG. 5 illustrates an example of an alternate method of securing the seating ring to an access conduit. Seating ring 46 includes an outer ring 48 that is adapted to snap on to a flanged portion 50 provided on the bottom of access conduit 52. Outer ring 48 may be configured in a variety of ways to snap on to the end of an access conduit, though it typically includes opposing outer and inner grasping portions 54 and 56, which cooperate to grasp the lower rim of access conduit. As a further alternative, the seating ring and valve cover body may be integrally formed as a single unitary structure.

FIG. 6 depicts an alternate embodiment of an access conduit according to the present invention. The depicted access conduit includes a seating ring 34 as described above with reference to FIGS. 2–4, but provides an alternate means for securing riser pipe 14 to the valve cover body, as will be later explained in detail. In the figure, the access conduit is installed and seated on gate valve bonnet 24. As will be appreciated from FIGS. 3, 4 and 6, opening 40 defined by the ends of fingers 38 (FIG. 4) is smaller than the portion of valve 16 received through the opening when the valve cover is seated. As a result, fingers 38 are deformed from their rest state and, due to their resilient character, urge against valve 16 to maintain the valve cover securely seated. As seen in FIG. 3, seating ring 34 may be provided with six fingers. Typically, the fingers are generally rectangular, with each finger tapering slightly in width toward the center of opening 40. Fingers of different shapes and sizes may be employed, however, and the seating ring may be provided with more or less than six fingers as desired.

The seating structure described above provides a number of advantages. First, no tools or additional fasteners are needed to mount the access conduit in place over the valve. Once the valve is installed, the seating structure maintains the access conduit in place without the installer having to manually hold the conduit. This frees the installer to backfill the areas surrounding the pipe and access conduit, or to perform other tasks during the backfilling operation. The seating structure automatically seats the valve cover in a centered and level position; the installer does not have to shift or manipulate the end of the access conduit to "find" the proper position. The described access conduit may thus be considered "self-seating."

Riser pipe 14 may be formed separately from and secured to the valve cover, as depicted in FIG. 2, or may be formed integrally with the valve cover. In either case, the riser pipe may be provided in a number of different lengths, or in one relatively long length that can be cut down appropriately, depending on the depth requirements for particular installations. The riser pipe typically has a circular cross section, with a diameter ranging from 6 inches to 12 inches or more.

When riser pipe 14 is formed separately from valve cover 12, the riser pipe may be secured to the valve cover by telescopically fitting the riser pipe and valve cover body together. For example, in the valve cover depicted in FIGS. 2 and 3, the top of the valve cover body is inserted inside the bottom end of riser pipe 14. The top of the valve cover body includes a number of elongate ridges 12*c* configured to contact and bear against the inner diameter of riser pipe 14. The ridges and/or valve cover body may be tapered to slightly increase in width toward the bottom of the valve cover body, in order to provide an increasingly snug fit as the valve cover body is inserted further into the riser pipe.

Alternatively, riser pipe 14 may be fitted inside the top of the valve cover body, as depicted in FIG. 6. In this configuration, the inside of the valve cover body may be provided with elongate ridges, similar to ridges 12*c*, in order to facilitate firmly securing the riser pipe and valve cover body together. The interior of the valve cover body may be provided with a lip, ledge or other stop, such as annular ledge 60, to prevent overinsertion of the riser pipe into the valve cover body. This alternate configuration may be desirable where it is important that the inner diameter of the access conduit be nondecreasing along its entire length (when moving from top to bottom through the access conduit). A region of decreased diameter may, in certain applications, obstruct the tool or cause it to hang up when being inserted through the conduit.

The access conduits described above may be provided with various other structures and features to facilitate installation and to ensure that the valve actuating mechanism is freely accessible from an aboveground location. As seen in FIG. 2, for example, the access conduit may be provided with a debris cap 62 or similar structure as desired to prevent debris from entering the conduit, such as during the backfilling operation. A level indicator 64 may be affixed to the debris cap, or to any part of the access conduit in order to provide the installer with visual confirmation that the access conduit is seated in the desired level position.

Figure 7:
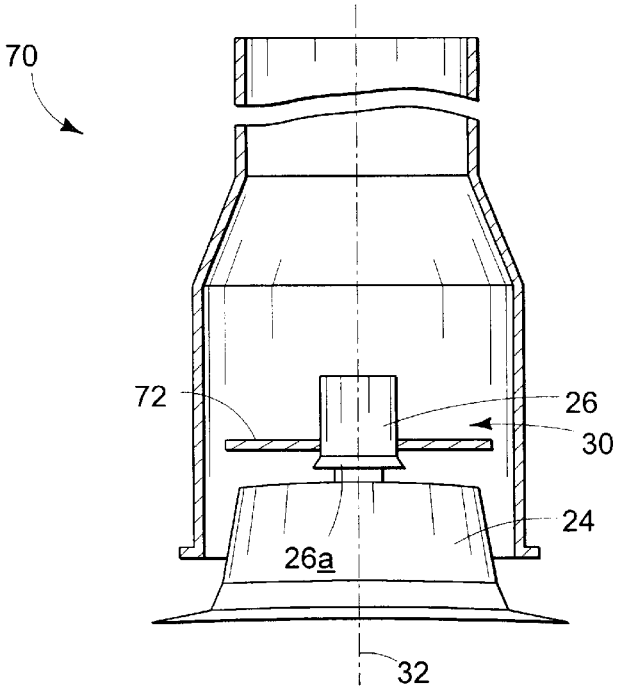
FIG. 7 is a partially cross-sectioned view of yet another embodiment of a valve cover according to the present invention.
Figure 8:
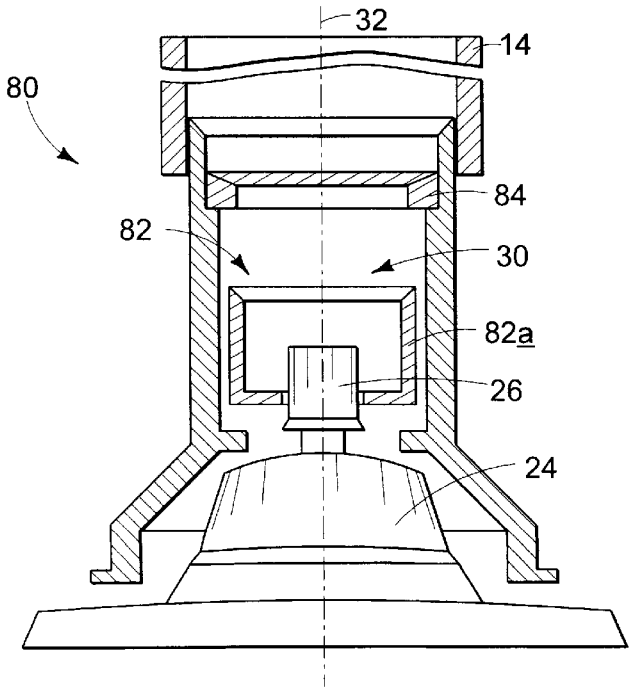
FIG. 8 is a partially cross-sectioned view of yet another embodiment of a valve cover according to the present invention.

FIGS. 7 and 8 depict embodiments of an access conduit constructed according to the present invention and having alternately configured seating structures. Access conduit 70 (FIG. 7) is similar in many respects to the access conduit depicted in FIG. 2. However, instead of a seating ring with flexible fingers, a disk-shaped spacer 72 is provided to hold the valve cover body in spaced relationship to actuating nut 26. Spacer 72 preferably is rigid and formed from a durable material such as plastic. The spacer typically is not secured to the internal wall of the valve cover body, and thus is permitted to vertically "float" along longitudinal axis 32 within the valve cover body. The outer edge of the spacer contacts or is closely spaced from the interior wall of the valve cover body. The spacer includes a central opening (not shown) sized large enough to receive actuating nut 26, but small enough so that base 26*a* of the actuating nut acts as a stop preventing further insertion of the nut through the opening in the spacer.

Once the valve cover is seated on the valve so that spacer 72 engages nut 26, the valve cover may be moved vertically due to the floating capability of the spacer. Though vertical movement is unrestricted, spacer 72 prevents lateral movement of the valve cover body while the spacer is engaged with nut 26. This ensures that valve cover 12 is maintained in a centered configuration relative to nut 26.

FIG. 8 depicts an access conduit 80 having a cylindrical spacer 82 that includes, similar to the spacer depicted in FIG. 7, a central opening for receiving and engaging nut 26. Spacer 82 is also allowed to vertically float along axis 32 within the interior of the valve cover body. Unlike the spacer depicted in FIG. 7, however, spacer 82 includes a cylindrical sidewall 82*a* that contacts or is closely spaced from the interior wall of the valve cover body. A capture ring 84 is secured to the interior wall of the valve cover body toward the top of the valve cover body. The capture ring acts as a stop that defines the upper limit of floating travel for the cylindrical spacer.

While the present invention has been particularly shown and described with reference to the foregoing preferred embodiments, those skilled in the art will understand that many variations may be made therein without departing from the spirit and scope of the invention as defined in the following claims. The description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element or the equivalent thereof, such claims should be understood to include incorporation of one or more such elements, neither requiring nor excluding two or more such elements.

We claim:

1. A valve cover for enclosing an underground area surrounding an actuating mechanism of a flow control valve, comprising:

an at least partially hollow valve cover body having open top and bottom ends; and a seating structure secured to the valve cover body and having a plurality of elastomeric fingers extending inward from the valve cover body, where the fingers are configured to contact the flow control valve to cause the valve cover body to seat in a desired orientation relative to the actuating mechanism, where the open top end of the valve cover body is configured to receive a tool therethrough to access and operatively engage the actuating mechanism of the flow control valve.

2. The valve cover of claim 1, where the seating structure includes six fingers.

3. The valve cover of claim 1, where the valve cover body is narrower near the top end than near the bottom end.

4. The valve cover of claim 1, where the top end of the valve cover body is configured to be telescopically fitted with an end portion of a length of riser pipe.

5. The valve cover of claim 4, where the top end of the valve cover body is configured to be inserted at least partially into the end portion of the length of riser pipe, so that an outer portion of the top end of the valve cover body contacts an inner wall of the riser pipe.

6. The valve cover of claim 4, where the top end of the valve cover body is configured so that the end portion of the length of riser pipe may be inserted into and received within the top end of the valve cover body, such that the top end of the valve cover body contacts an outer wall of the riser pipe.

7. The valve cover of claim 1, where the valve cover body has a generally circular cross section.

8. The valve cover of claim 1, where inner ends of the fingers define an opening through which a portion of the valve is received to seat the valve cover body valve cover on the flow control valve in a desired orientation relative to the valve actuating mechanism.

9. The valve cover of claim 8, where the opening defined by the fingers is smaller, when the fingers are in an undeformed rest state, than the portion of the flow control valve received through the opening when the valve cover is seated upon the flow control valve.

10. The valve cover of claim 1 where the seating structure releasably snaps to the bottom end of the valve cover body to secure the seating structure to the valve cover body without the use of additional fasteners.

11. The valve cover of claim 1, further comprising a level indicator affixed to the valve cover and configured to provided visual indication of whether the valve cover body is seated upon the flow control valve in a level orientation.

12. A valve cover for enclosing an underground volume surrounding an actuating mechanism of a flow control valve, comprising:

a valve cover body sized to enclose the underground volume, the underground volume being large enough to accommodate insertion of a valve tool therein for purposes of engaging and operating the actuating mechanism;

an at least partially elastomeric seating structure extending inward from the valve cover body, the seating structure being configured to contact the flow control valve and resiliently deform in response to placing the valve cover body in a desired position in which the underground volume is enclosed by the valve cover body, to thereby seat the valve cover body and maintain the valve cover body in the desired position.

13. The valve cover of claim 12, where the seating structure includes an opening through which a portion of the flow control valve is received when the valve cover body is seated in the desired position, and where, when the seating structure is in an undeformed rest position, the opening in the seating structure is smaller than the portion of the flow control valve.

14. The valve cover of claim 13, where the seating structure includes a plurality of elastomeric fingers having inner ends which define the opening of the seating structure.

15. The valve cover of claim 12, where the seating structure includes a plurality of inward-extending elastomeric fingers.

16. The valve cover of claim 15, where the seating structure has six inwardextending elastomeric fingers.

17. The valve cover of claim 12, where the valve cover includes an open top end and an open bottom end, and is narrower near the top end than near the bottom end.

18. The valve cover of claim 17, where the top end of the valve cover body is configured to be telescopically fitted with an end portion of a length of riser pipe.

19. The valve cover of claim 18, where the top end of the valve cover is configured to be inserted at least partially into the end portion of the length of riser pipe, so that an outer portion of the top end of the valve cover contacts an inner wall of the riser pipe.

20. The valve cover of claim 18, where the top end of the valve cover is configured so that the end portion of the length of riser pipe may be inserted into and received within the top end of the valve cover, such that the top end of the valve cover contacts an outer wall of the riser pipe.

21. The valve cover of claim 12, where the valve cover has a generally circular cross section.

22. An enclosure for facilitating operation of an underground valve, comprising:

an at least partially hollow valve cover having an interior wall and open top and bottom ends, the valve cover being configured to be positioned over an actuating mechanism used to selectively control flow through the underground valve; and a centering device having a central valve-engaging portion configured to engage the actuating mechanism of the valve so that the centering device extends between the actuating mechanism and the interior wall of the valve cover to maintain the interior wall in a spaced relationship to the actuating mechanism, and so that the interior wall encloses a volume surrounding the actuating mechanism that is large enough to permit a valve tool to be inserted therein and operatively engaged with the actuating mechanism.

23. The enclosure of claim 22, where the centering device includes a disk with a central opening for receiving and engaging the actuating mechanism of the underground valve.

24. The enclosure of claim 23, where the centering device further includes a generally cylindrical sidewall extending upward from an outer edge of the disk.

25. The enclosure of claim 22, where the valve-engaging portion includes a hole through which the valve actuating mechanism is received.

26. The enclosure of claim 22, where the centering device is configured to float vertically within the valve cover.

* * * * *